US005400129A

United States Patent [19]

Lange et al.

[11] Patent Number: 5,400,129

[45] Date of Patent: Mar. 21, 1995

[54] OPTIMIZING CLEANER BIAS FOR CLEANING MULTIPLE TONERS

[75] Inventors: Clark V. Lange, Ontario; Robert P. Siegel, Penfield, both of N.Y.

[73] Assignee: Xerox Corporation, Stamford, Conn.

[21] Appl. No.: 166,372

[22] Filed: Dec. 13, 1993

[51] Int. Cl.[6] ..... G03G 21/00

[52] U.S. Cl. ..... 355/301; 15/1.51; 15/256.5; 355/303

[58] Field of Search ..... 355/203, 208, 296, 298, 355/301-303, 305, 326, 327; 15/256.5, 256.51, 256.52, 1.51; 118/652, 645; 346/157

[56] References Cited

U.S. PATENT DOCUMENTS

| | | | |
|---|---|---|---|
| 4,533,236 | 8/1985 | Garsin | 355/303 X |
| 4,599,285 | 7/1986 | Haneda et al. | 430/54 |
| 4,615,613 | 10/1986 | Garsin | 355/303 |
| 4,679,929 | 7/1987 | Haneda et al. | 355/326 X |
| 5,175,584 | 12/1992 | Usui | 355/208 |
| 5,175,590 | 12/1992 | Frankel et al. | 355/296 |

FOREIGN PATENT DOCUMENTS

| | | | |
|---|---|---|---|
| 1-159679 | 6/1989 | Japan | 355/303 |
| 4-29283 | 1/1992 | Japan | 355/303 |
| 4-124690 | 4/1992 | Japan | 355/303 |
| 4-174488 | 6/1992 | Japan | 355/303 |

*Primary Examiner*—William J. Royer
*Attorney, Agent, or Firm*—T. L. Fair

[57] ABSTRACT

A method and apparatus for adjusting the bias of a cleaner used in a printer or digital copier such that the cleaner bias is optimized for the dominant color entering the cleaner.

21 Claims, 3 Drawing Sheets

OPTIMIZING CLEANER BIAS FOR CLEANING MULTIPLE TONERS

BACKGROUND OF THE INVENTION

This invention relates generally to an electrostatographic printing or copying machine which utilizes multiple toners, such as in the formation of multi-color images and more particularly, cleaning brushes to remove toner additive film particle buildup on the photoconductive member.

In a colored image forming apparatus, an electrostatic latent image which is to be developed by a predetermined color is formed on a photoconductor by an optical system of a copying machine or printer. Then, the electrostatic latent image is developed by a developing unit which accommodates a predetermined colored toner to be used for development. This toner image may be subsequently transferred to a support surface such as copy paper or other medium to which it may be permanently affixed by heating or by the application of pressure. After each transfer process, the toner and other debris particles (i.e. residual particles) remaining on the photoconductor is cleaned by a cleaning device.

The brush bias latitude of an electrostatic brush (ESB) cleaner is defined by evaluating performance at a number of brush bias conditions. A setpoint is chosen by stressing the input to the cleaner and choosing the point upon which the latitude converges. This is fairly straightforward process when single toner type systems are used. However, when multiple toner types are used a problem is encountered. The latitudes may, in fact, converge to different brush bias setpoints. This has been observed, for example, in cleaning latitude tests conducted on a Xerox 5090 with one additional color station added. With the Xerox 5090, the black toner bias setpoint convergence was different than for the red toner.

The following disclosure may be relevant to various aspects of the present invention and may be briefly summarized as follows:

U.S. Pat. No. 4,533,236 to Garsin discloses a magnetic brush cleaner for removing residual charged particles such as toner from a charge-retentive surface such as a photoreceptor. The brush cleaner has a bias voltage applied thereto for establishing an electrostatic field for aiding in toner removal. A control is provided for varying the bias voltage applied to the brush cleaner in accordance with variations in photoreceptor potential to thereby maintain the cleaning potential (i.e. the difference between the applied bias voltage and the photoreceptor potential) invariant.

SUMMARY OF INVENTION

Briefly stated, and in accordance with one aspect of the present invention, there is provided a method for cleaning particles from an imaging surface, comprising the steps of: determining the color of the particles to be used to develop a latent image recorded on the imaging surface; recording the latent image on the imaging surface; developing the recorded latent image on the imaging surface with the particles; adjusting an electrical bias being applied to a cleaner, in response to the color of the particles determined by the determining step; and using the cleaner having the electrical bias adjusted to remove the particles from the imaging surface.

Pursuant to another aspect of the present invention, there is provided an apparatus for removing particles from an imaging surface, comprising: means for determining the color of the particles to be used to develop a latent image recorded on the imaging surface; means for recording the latent image on the imaging surface; means for developing the recorded latent image on the imaging surface with the particles; means for adjusting an electrical bias being applied to a cleaner in response to the color of the particles determined by said determining means; and means for cleaning, having an electrical bias adjusted to remove the particles from the imaging surface.

BRIEF DESCRIPTION OF THE DRAWINGS

Other features of the present invention will become apparent as the following description proceeds and upon reference to the drawings, in which.

Figure 1:
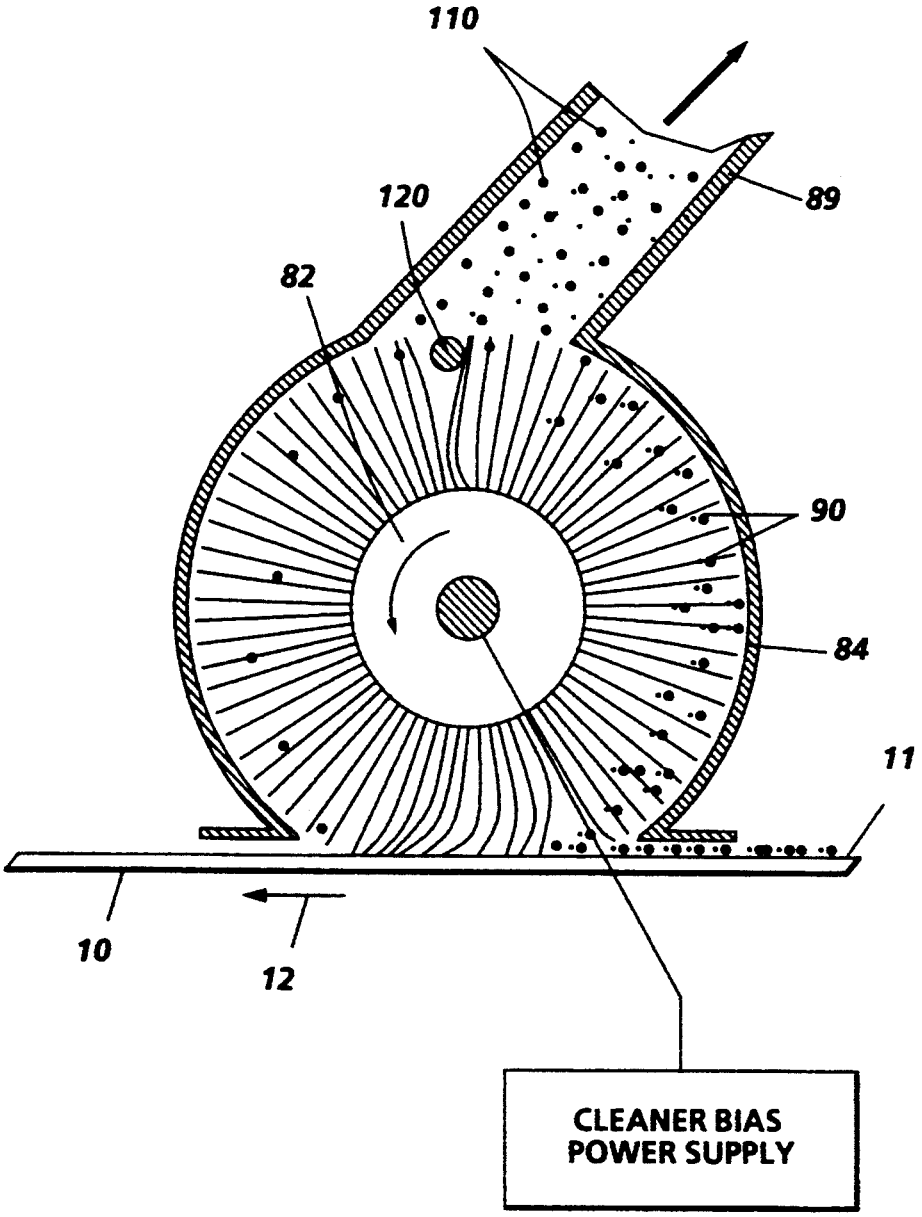
FIG. 1 is a schematic elevational view showing a brush cleaning system with bias applied.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Referring now to the drawings, where the showings are for the purpose of describing a preferred embodiment of the invention and not for limiting same.

Referring now to FIG. 1 which shows a cleaning brush system. The electrostatic brush 82 used for cleaning (e.g. cleaner brush) is located in a cleaner housing 84. The fibers 90 rotate against the surface of the photoreceptor 10. The photoreceptor 10 moves in the direction shown by arrow 12. The electrostatic brush 82 has a bias (i.e. AC or DC) applied to attract toner 110 from the imaging surface 11. When a DC bias is applied to the brush 82, one setpoint (i.e. voltage) is required for the right sign toner. However, when an AC bias is applied to the brush 82, two setpoints are required, one for right sign toner and the other setpoint for wrong sign toner. Another requirement of the AC biased brush in a single brush system, is that 100% detoning occur to prevent redeposition of particles back on the cleaned imaging surface. (In a dual cleaner system, which the present application is also applicable to, the secondary cleaning device would be available to remove redeposited particles.)

With continued reference to FIG. 1, the electrostatic brush 82 rubs against the flicker bar 120 as the brush rotates. An air vacuum 89 is used to remove debris from the brush fibers 90, out of the housing 84, and deposits this toner and other waste material cleaned from the imaging surface 11 into a waste container (not shown).

Figure 2:
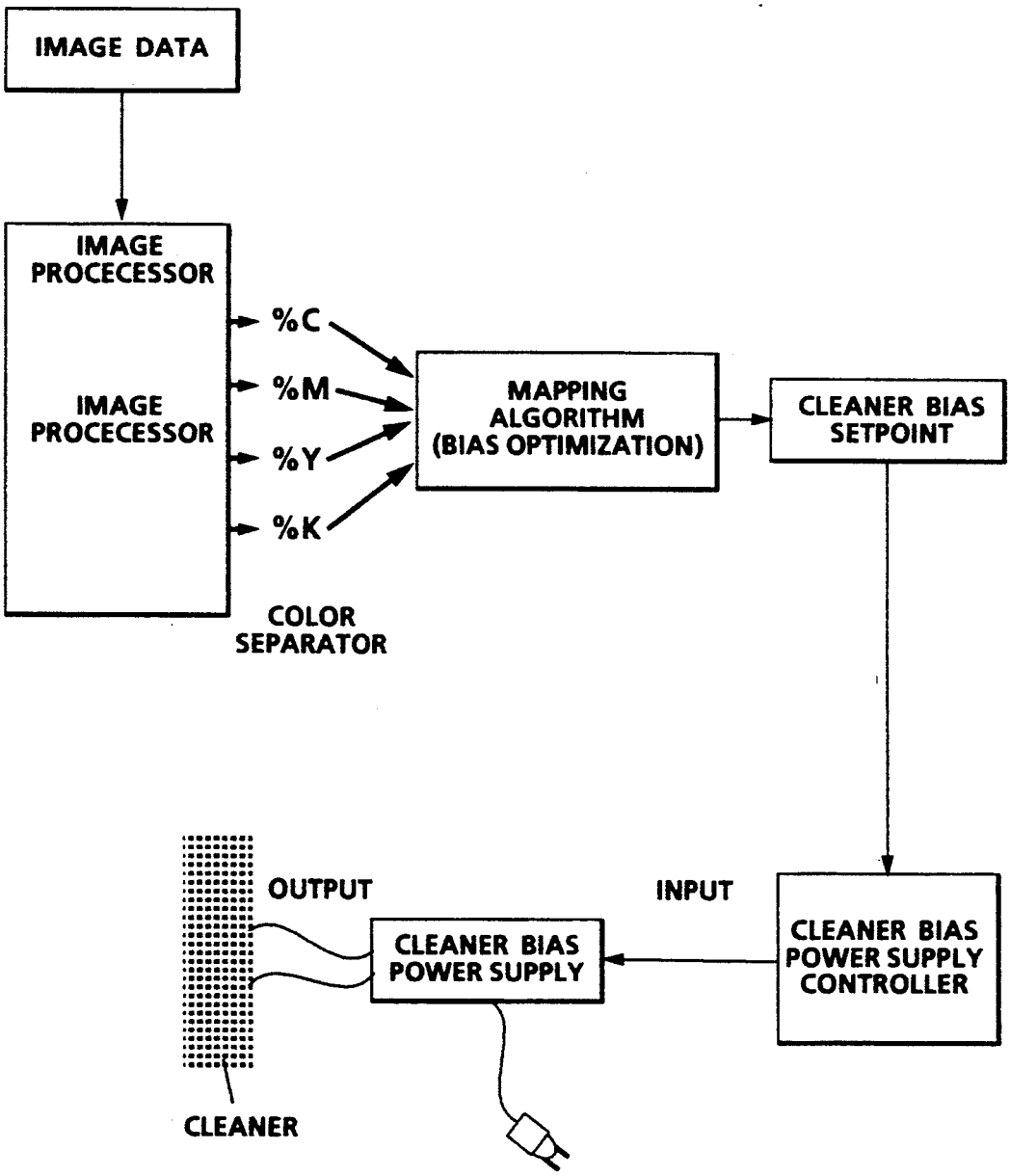
FIG. 2 is a block diagram of the process used in the present invention.

To provide an overview of the process in which the present invention is incorporated, reference is now made to FIG. 2, which shows a flow chart of the process. The Image Data is processed in an Image Processor which separates the color pixels into cyan, magenta, yellow and black. A printer or a copier may be used in the present invention. They only differ in how each reaches the color separation of the pixels. In a printer operation, a network feeds information or imaged data to a printer in Page Description Language (PDL). The image is then processed where it is decomposed then converted to cyan, magenta, yellow and/or black via a color separator. In a digital copier, the image is scanned in from a document and converted into cyan, magenta, yellow and black by an Image processor. The dominant color among those exiting the Color Separator can be determined, for example, by a pixel counting algorithm, which is a technique that will also be usually employed to monitor toner usage in the developer systems. Examples of pixel counting techniques are described in U.S. Pat. Nos. 5,204,698 and 5,204,699, whose contents are incorporated herein by reference. (Other methods of determining the dominant color, besides pixel counting include the use of a color densitometer or some type of sensor to pick up the dominant color.) In the light lens case, where the image data is not directly available in a digital form, an optical sensor, such as the type which is currently used to monitor image density or area coverage could be used to determine the approximate color distribution.

With continued reference to FIG. 2, the present invention adjusts the Cleaner Bias Setpoint of a cleaner [e.g. an electrostatic brush (ESB)] when used in a printer or digital copier such that the cleaner bias is optimized for the dominant color entering the cleaner. (The dominant color is the color that there is the most of in an image that is passing under a cleaner at a given time.) The cleaner bias level is adjusted per image and also within the image, meaning that the dominant color is determined from image to image and, in some cases, at different points within the same image. One particularly stressful case for any type of cleaning system is the removal of the high density solid area patches which are occasionally developed for use in process control. This is particularly stressful to the cleaner because these images are not being transferred to paper, so all of the toner must be removed by the cleaner. In the present invention, the dominant color pixel data is transmitted to an IOT controller. The IOT controller processes the information through a microprocessor to supply the appropriate bias to the cleaner. In the case of a color IOT, these patches will occur in each of four colors: cyan, magenta, yellow and black (C,M,Y, and K, respectively). Using the variable bias scheme described in this application, it is possible to set the cleaner brush bias directly to the optimal set point for each individual color, thus achieving the maximum cleaning effectiveness in the situation where it is needed most. The image definition could be accomplished by pixel counting. In the case where no dominant color exists (i.e. the pixel counts for more than one color are close in value), the cleaner bias is set to the best compromise setting among the color pixels. Cleaning optimization for any combination of colors would also be possible.

Continuing reference to FIG. 2, the range over which the bias would be adjusted would be relatively small (e.g. probably less than 100 v) and the time would be fairly long. For example, a time span of approximately 100 msec at 10 ips (inches per second) process speed is required to make an adjustment in 1 inch of photoreceptor (i.e. imaging surface) travel. The Image Processor has already determined the dominant color pixels of the image and it provides this information to the Microprocessor so that the proper bias is applied to remove the dominant color particles from the imaging surface when the particles reach the cleaner. The combination of speed and distance are used to inform the cleaner at what point the appropriate bias should be applied. This should not place unreasonable constraints on the power supply design. Faster response could be provided if required.

The present invention has application to the color engines that are presently being developed and that will be developed in the future. Most of these engines will employ ESB cleaners because the ESB cleaner is the cleaner of choice for future high volume applications. Furthermore, this invention can be extended beyond ESB cleaners, and could be applied to magnetic brush cleaners, or any cleaner that relied on an applied brush bias to enable cleaning.

Figure 3:
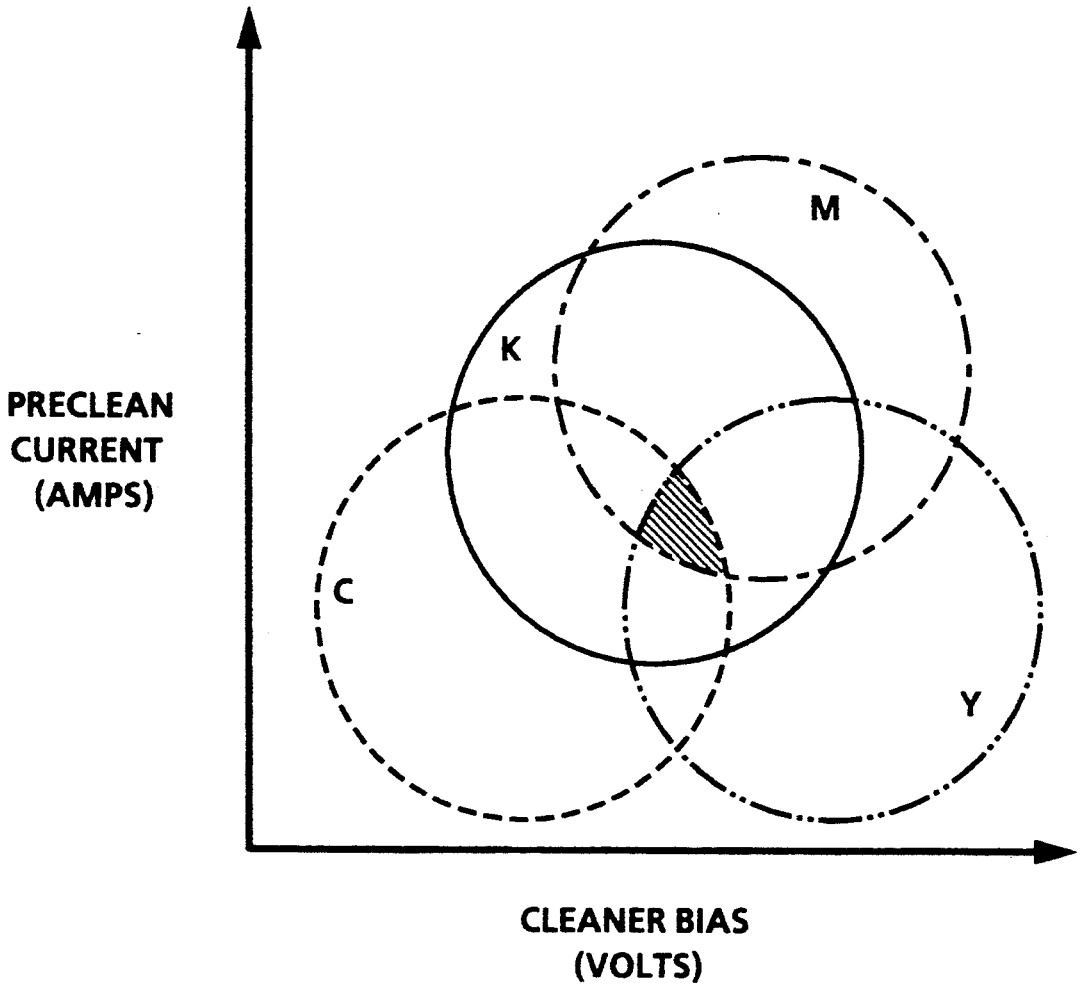
FIG. 3 is a graphic diagram of the color latitudes.

Reference is now made to FIG. 3, which shows an example of cleaning latitudes, graphically, for cyan (C), magenta (M), yellow (Y) and black (K). The horizontal axis represents the brush bias to be applied, increasing from left to right, to clean these colors from a surface. The vertical axis represent the preclean current needed for proper cleaning. The circular area for each color represents the latitude or the best bias and preclean current combination to achieve optimum cleaning of that color. [Note that although there is a region in which an operating latitude exists for all three colors (see the shaded region in FIG. 3, where the three circles overlap) it is a relatively small region.] Knowledge of the actual image content allows the system to precisely target the appropriate operating region on a case by case basis. Thus, in the present invention, when the dominant color is determined, the optimum bias and preclean current is determined from the latitude and this is the bias that is applied for cleaning. It should also be noted that the present invention can also be applied to other types of image forming apparatus such as those in which multi-color images are transferred from the photoreceptor to paper, one color at a time, thus enabling the cleaner bias to be adjusted to the optimal setpoint for each color to ensure optimal cleaning.

In recapitulation, the present invention provides an adjustable bias to the cleaner used in a printer or digital copier such that the cleaner bias is optimized for the dominant color entering the cleaner. One way of determining the dominant color is by pixel counting.

It is, therefore, apparent that there has been provided in accordance with the present invention, an optimizing cleaner bias apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of cleaning particles from an imaging surface, comprising the steps of:

determining the color of the particles to be used to develop a latent image recorded on the imaging surface;

recording the latent image on the imaging surface;

developing the recorded latent image on the imaging surface with the particles;

adjusting an electrical bias being applied to a cleaner, in response to the color of the particles determined by said determining step; and using the cleaner having the electrical bias adjusted to remove the particles from the imaging surface.

2. The method of claim 1, wherein said determining step comprises the step of counting pixels for the color of the particles.

3. The method of claim 2, wherein said counting pixels step comprises the step of processing image data to determine the color of the particles.

4. The method of claim 3, wherein said processing step comprises the step of separating the image data into color pixels to determine a dominant color.

5. The method of claim 4, wherein said determining step further comprises the step of determining a bias setpoint for the cleaner.

6. The method of claim 5, wherein the imaging surface for the recording step comprises an imaging region and a non-imaging region thereon.

7. The method of claim 6, wherein said developing step comprises the step of forming the image developed with the particles in the imaging region.

8. The method of claim 7, wherein said developing step comprises the step of developing color patches in the non-imaging region.

9. The method of claim 8, further comprising the step of transferring the image in the imaging region to a medium.

10. The method of claim 9, wherein said adjusting step comprises the step of increasing and decreasing the bias to the cleaner as determined by said determining step.

11. The method of claim 10, wherein said using step comprises the step of holding, electrostatically, in the cleaner, the particles removed from the imaging surface.

12. The method of claim 11, further comprising the step of removing the particles from the cleaner.

13. An apparatus for removing particles from an imaging surface, comprising:

means for determining the color of the particles to be used to develop a latent image recorded on the imaging surface;

means for recording the latent image on the imaging surface;

means for developing the recorded latent image on the imaging surface with the particles;

means for cleaning the particles from the imaging surface; and means for adjusting an electrical bias being applied to the cleaning means in response to the color of the particles determined by said determining means.

14. An apparatus as recited in claim 13, wherein said determining means comprises pixel counting of the color of the particles.

15. An apparatus as recited in claim 14, wherein said determininq means comprises:

image data, having color pixels therein;

an image processor for processing said image data; and a color separator for processing said image data into the color pixels to determine dominant color pixels of the particles.

16. An apparatus as recited in claim 15, wherein said determining means comprises a bias setpoint for said cleaning means.

17. An apparatus as recited in claim 16, wherein said adjusting means comprises a power supply for varying the bias applied to said cleaning means, the bias being increased and decreased by said power supply according to the bias required for optimum cleaning of the particles from the imaging surface.

18. An apparatus as recited in claim 17, wherein said cleaning means comprises a brush.

19. An apparatus as recited in claim 18, wherein said brush is electrostatic.

20. An apparatus as recited in claim 19, further comprising means for removing the particles cleaned from the imaging surface from said brush.

21. An apparatus as recited in claim 20, wherein said removing means comprises a flicker bar.

* * * * *